US010065237B2

(12) United States Patent
Richaud et al.

(10) Patent No.: US 10,065,237 B2
(45) Date of Patent: Sep. 4, 2018

(54) NOZZLE AND CASTING INSTALLATION

(71) Applicant: VESUVIUS CRUCIBLE COMPANY, Wilmington, DE (US)

(72) Inventors: Johan Richaud, Cheval Blanc (FR); Martin Kreierhoff, Suedlohn (DE); Christian Warmers, Rhede (DE)

(73) Assignee: VESUVIUS USA CORPORATION, Champaign, IL (US)

( * ) Notice: Subject to any disclaimer, the term of this patent is extended or adjusted under 35 U.S.C. 154(b) by 178 days.

(21) Appl. No.: 15/034,997

(22) PCT Filed: Nov. 7, 2014

(86) PCT No.: PCT/EP2014/074006
§ 371 (c)(1),
(2) Date: May 6, 2016

(87) PCT Pub. No.: WO2015/067733
PCT Pub. Date: May 14, 2015

(65) Prior Publication Data

US 2016/0288204 A1 Oct. 6, 2016

(30) Foreign Application Priority Data

Nov. 7, 2013 (EP) ..... 13191871
Nov. 7, 2013 (EP) ..... 13191876

(51) Int. Cl.

| | |
|---|---|
| ***B22D 41/50*** | (2006.01) |
| ***B22D 11/00*** | (2006.01) |
| ***B22D 35/04*** | (2006.01) |
| ***B22D 41/08*** | (2006.01) |

(52) U.S. Cl.
CPC ..... *B22D 41/50* (2013.01); *B22D 11/009* (2013.01); *B22D 35/04* (2013.01); *B22D 41/08* (2013.01)

(58) Field of Classification Search
CPC ..... B22D 41/50; B22D 11/009; B22D 35/04; B22D 41/08
See application file for complete search history.

(56) References Cited

U.S. PATENT DOCUMENTS 3,931,850 A 1/1976 Landgraf et al.

FOREIGN PATENT DOCUMENTS

| | | | |
|---|---|---|---|
| JP | S58224050 | A | 12/1983 |
| JP | H115144 | A | 1/1991 |
| JP | H05146858 | A | 6/1993 |
| JP | H09122855 | A | 5/1997 |

*Primary Examiner* — Kevin P Kerns
*Assistant Examiner* — Steven S Ha
(74) *Attorney, Agent, or Firm* — Thomas Clinton; Donald M. Satina

(57) ABSTRACT

A nozzle for casting steel contains an inlet portion, an elongated portion extending along a first longitudinal axis, an outlet portion and a pouring bore having a front port inlet. A planar cut of the nozzle outlet portion normal to the first longitudinal axis passing through the front port inlet contains the outline of the bore, the outline of the outer peripheral wall of the outlet portion of the nozzle, and a first transverse axis. In the planar cut, the bore centroid and wall centroid are distinct and separated by a distance, $d \neq 0$; and the segment extending along the first transverse axis, from the bore centroid, to the wall perimeter is longer than the segment extending from the wall centroid to the intersecting point between the first transverse axis and the wall perimeter.

15 Claims, 8 Drawing Sheets

(b)

NOZZLE AND CASTING INSTALLATION

BACKGROUND OF THE INVENTION

Field of the Invention

The present invention relates to nozzles for casting metal beams, such as H-beams and the like. The nozzle of the present invention allows a better control of the metal flow into a mould, yielding metal beams with low defects.

Description of the Related Art

In metal forming processes, metal melt is transferred from one metallurgical vessel to another, to a mould or to a tool. For example, as shown in FIG. 1 a ladle (11) is filled with metal melt out of a furnace and transferred to a tundish (10). The metal melt can then be cast through a pouring nozzle (1) from the tundish to a mould for forming slabs, billets, beams or ingots. Flow of metal melt out of a metallurgic vessel is driven by gravity through a nozzle system (1, 111) located at the bottom of said vessel. In particular, the tundish (10) is provided at its bottom floor (10*a*) with a nozzle (1) bringing in fluid communication the interior of the tundish with the mould. Some installations make without a tundish and connect the ladle directly to the mould.

In some cases, two nozzles are used for a single mould in order to ensure optimal filling of the mould and thermal profile of the metal flowing into the mould. This solution may be used for simple rectangular profiles, such as in U.S. Pat. No. 3,931,850, but it is usually used for moulding complex shaped metal parts, such as H-shaped beams or similar. For example, JPH09122855 discloses a H-beam mould fed by two nozzles located at the intersections between each flange with web of the H-beam (note that the "flanges" refer to the two lateral elements of the "H" and the "web" refers to the middle element connecting both flanges; H-beams are also often referred to as I-beams, the two terms being used herein as synonyms). Using two nozzles for a single mould yields several drawbacks. First, the production costs are increased since two nozzles are required, instead of a single one. Second, the flow rates of the two nozzles must be well coordinated during casting, lest the overall metal feeding flow becomes uneven. This is not easy to achieve.

H-beam casting installations have been proposed comprising a single nozzle per mould, thus solving the drawbacks discussed above associated with the use of two nozzles as described, for example; in JPS58224050, JPH115144, and JPH05146858. In each of the foregoing documents, a single nozzle comprising an end outlet as well as front ports opening at the peripheral wall of the nozzle is positioned at the intersection between one flange only and the web of the H-mould. Because of its offset position with respect to the mould such nozzles have a more complex front ports design which openings are not distributed around the perimeter of the nozzle symmetrically with respect to a vertical plane as it would be the case in nozzles positioned symmetrically with respect to a mould. They comprise at least a first front port extending parallel to the web, and opening towards the opposite flange of the H-mould. In order to ensure proper filling of the corners of the flange located on the nozzle side, the foregoing nozzles also comprise two front ports forming a Y with the first front port. The front ports usually extend downwards.

The size of the nozzle is limited by the clearance available at the intersection of the flange with the web of the H-mould, keeping in mind that contact between the nozzle and the mould walls should be avoided, lest solidified metal bridges would form between the nozzle and the cold mould walls. This has consequences on the flow rate achievable by such nozzles, which size of the peripheral wall is limited, thus limiting the size of the axial bore and front ports too. JPH09122855 proposes a pair of nozzles having a triangular cross-sectional shape, with rounded corners, in order to optimize the clearance available at the intersection points between each flange and the web of the H-mould. Said nozzles are provided with an end outlet only, also triangular in shape, and comprise no front ports.

The flow profile and thermal profile of the molten metal filling the mould are of course of prime importance to ensure the production of flawless beams. Both flow and thermal profiles in H-beam moulds are very sensitive to the design of such single nozzles and, in particular, to the number, location, and design of the front ports. For example, it is important to ensure a filling of the mould which is stable in time, that avoids as far as possible metal jets hitting a mould wall with excessive momentum, which creates uncontrolled turbulences and rapidly erodes the mould thus decreasing service life thereof. When vortices and turbulences are formed, cooling of the beam becomes more difficult to control and flaws appear.

It is an object of the present invention to provide a nozzle suitable for filling complex shaped moulds such as H-beams, T-beams, L-beams, C-beams, and the like, yielding enhanced control of the metal jets penetrating into such mould, resulting in smoother flow and thermal profiles and, ultimately, in metal beams with very low flaw concentrations. This and other advantages of the present invention are presented in the following sections.

BRIEF SUMMARY OF THE INVENTION

The present invention is defined in the appended independent claims. Preferred embodiments are defined in the dependent claims. In particular, the present invention concerns a submerged nozzle for casting steel, the nozzle having an exterior and comprising:

- an inlet portion, located at a first end of the nozzle and comprising an inlet orifice;
- an elongated portion defined by an outer peripheral wall and extending along a first longitudinal axis, X1, from said inlet portion, or adjacent thereto, to,
- an outlet portion, located adjacent to and including a second end of the nozzle, opposite the first end, said outlet portion being defined by an outer peripheral wall and comprising a first outlet front port opening on said outer peripheral wall,
- a bore extending parallel to the first longitudinal axis, X1, opening at said inlet orifice and extending along the elongated portion of the nozzle and at least partly in the outlet portion of the nozzle whence it opens to the exterior or atmosphere at least through said first front port, which extends along front port direction, Y1, transverse to said first longitudinal axis, X1, from a front port inlet joining the bore to a front port outlet opening at the outer peripheral wall of the outlet portion of the nozzle,
- wherein a planar cut of the nozzle outlet portion along a plane normal to the first direction, X1, passing through the front port inlet comprises:
  - the outline of the bore (50), defined by the bore perimeter (50P) and by the bore centroid (50*x*) of the area defined by said bore perimeter and,
  - the outline of the outer peripheral wall of the outlet portion of the nozzle defined by the wall perimeter (1P) and the wall centroid (1*x*) of the area defined by said wall perimeter, and a first transverse axis, Y, passing by the bore centroid (50*x*) and extending along a direction parallel to the orthogonal projection of the front port direction, Y1, onto the plane of the cut, characterised in that, the peripheral wall of both elongated portion (1B) and outlet portion is centred about the longitudinal axis, X1, over the majority of the whole length of, or over substantially the whole length of, the nozzle, and wherein at least at the level of the first front port, the bore changes geometry extending along a second longitudinal axis, X2, parallel to, and offset with respect to the first longitudinal axis, X1, in the direction opposite to the first front port, the nozzle comprises no front port extending along a direction opposite to the direction of the first front port (35) with respect to the first longitudinal axis, X1, and belonging to the plane defined by the longitudinal axis, X1, and the front port direction, Y1, and in that, in said planar cut:

the bore centroid (50*x*) and wall centroid (1*x*) are distinct and separated by a distance, d≠0.

The segment extending along the first transverse axis, Y, from the bore centroid (50*x*), to the wall perimeter (1P) has a length, L1, which is longer than the length, L2, of the segment extending from the wall centroid (1X) to the intersecting point between the first transverse axis, Y, and the wall perimeter (1P). The L1/L2 ratio is preferably at least equal to 1.05, more preferably at least, 1.1, most preferably at least 1.25.

Such geometry allows a substantial elongation of the front port channel, which allows a more stable metal flow and a dissipation of momentum thereof as hitherto possible with traditional nozzles having concentric bore and peripheral wall.

The expression "opening to the atmosphere" means opening to the atmosphere surrounding the exterior of the nozzle. If the nozzle front port is inserted in the cavity of a mould, the "atmosphere" refers to the space defined by the cavity of the mould surrounding said nozzle front port. A "front port" is used herein in its commonly accepted definition of a port channel in fluid communication with, and extending transverse from the axial bore and comprising an outlet opening at least partially at the nozzle peripheral wall. It includes ports opening partly at the second end of the nozzle, if they also open at the peripheral wall, such as the lower front port in FIG. 3.

The "centroid" of a plane figure or two-dimensional shape is defined as the arithmetic mean ("average") position of all the points in the shape. In other words, it is the point at which a cardboard cut-out of the region could be perfectly balanced on the tip of a pencil (assuming uniform density and a uniform gravitational field). In geometry the term "barycenter" of a two-dimensional figure is a synonym for "centroid", and in physics, the "barycenter" and "centroid" form a single point for shapes of uniform density only.

In a preferred embodiment, the change in geometry of the bore comprises the bore getting thinner at least along the direction of the first transverse axis, Y. Else the first and second longitudinal axes (X1) and X2, may be coaxial.

It is preferred that the outlet portion further comprises an end outlet opening at the second end of the nozzle. It is further preferred that the outlet portion further comprises at least one secondary front port extending transversally to both longitudinal axis, X1, and front port axis, from the bore to the peripheral wall of the outlet portion. It is more preferred that at least two such secondary front ports be provided, forming with the first front port a Y-shape. Better dissipation of the metal flow momentum is obtained when the outlet portion further comprises a second front port extending along an axis comprised within the half-plane defined by the longitudinal axis, X1, and the front port axis. Such second front port is located either above or below the first front port.

The first front port may extend normal to the longitudinal axis, X1, or downwards. In other words, the centroid of the front port outlet can be at the same distance from the nozzle second end as, or closer thereto than the centroid of the front port inlet.

The present invention also concerns a casting installation for casting metal beams comprising:

(a) A metallurgical vessel (10, 11) provided with at least one submerged nozzle (1) extending parallel to a first longitudinal axis (X1) and coupled to the floor of the metallurgical vessel, said nozzle comprising an inlet portion (1A), located at a first end of the nozzle and comprising an inlet orifice (18);

an elongated portion (1B) defined by an outer peripheral wall and extending along a first longitudinal axis (X1) from said inlet portion (1A), or adjacent thereto, to, an outlet portion (1C), located adjacent to and including a second end of the nozzle, opposite the first end, said outlet portion being defined by an outer peripheral wall and comprising a first outlet front port (35) opening on said outer peripheral wall, a bore (50) extending parallel to the first longitudinal axis (X1) opening at said inlet orifice (18) and extending along the elongated portion (1B) of the nozzle and at least partly in the outlet portion (1C) of the nozzle whence it opens to the atmosphere at least through said first front port (35), which extends along a front port direction (Y1) transverse to said first longitudinal axis (X1) from a front port inlet (35*i*) joining the bore (50) to a front port outlet (35*o*) opening at the outer peripheral wall of the outlet portion of the nozzle, wherein a planar cut of the nozzle outlet portion (1C) along a plane normal to the first longitudinal axis (X1) passing through the front port inlet (35*i*) comprises:

the outline of the bore (50), defined by the bore perimeter (50P) and by the bore centroid (5*x*) of the area defined by said bore perimeter and, the outline of the outer peripheral wall of the outlet portion of the nozzle defined by the wall perimeter (1P) and the wall centroid (1*x*) of the area defined by said wall perimeter, and a first transverse axis (Y) passing by the bore centroid (50*x*) and extending along a direction parallel to the orthogonal projection of the front port direction (Y1) onto the plane of the cut, (b) A beam blank mould (100) defining a cross-section divided in at least a first elongated portion extending along a first mould direction and at least a second elongated portion, extending along a second mould direction transverse to the first mould direction, characterized in that, the nozzle comprises no front port extending along a direction opposite to the direction of the first front port (35) with respect to the longitudinal axis and belonging to the plane defined by the longitudinal axis (X1) and the front port direction (Y1) and in that, in said planar cut:

the bore centroid (50*x*) and wall centroid (1*x*) are distinct and separated by a distance, d≠0.

The segment extending along the first transverse axis (Y) from the bore centroid (50*x*), to the wall perimeter (1P) has a length (L1) which is longer than the length (L2) of the segment extending from the wall centroid (1X) to the intersecting point between the first transverse axis (Y) and the wall perimeter (1P), and in that, said first mould direction is comprised within the plane comprising the first longitudinal axis (X1) and the front port direction, Y1.

The blank beam mould in the casting installation of the present invention may have a T-cross-section, an L-cross-section, an X-cross-section, a C-cross-section, or a H-cross-section. The blank beam mould preferably has a H-cross-section with the web of the H being defined by the first elongated portion, and the two lateral flanges being defined by the second elongated portion and a third elongated portion, both normal to the second elongated portion, and wherein said submerged nozzle is positioned at the area intersecting a flange and the web of the H-beam cross-section. The casting installation of the present invention preferably comprises a single submerged nozzle per blank beam mould.

BRIEF DESCRIPTION OF THE SEVERAL VIEWS OF THE DRAWINGS

For a fuller understanding of the nature of the present invention, reference is made to the following detailed description taken in conjunction with the accompanying drawings in which.

DETAILED DESCRIPTION OF THE INVENTION

Figure 3:
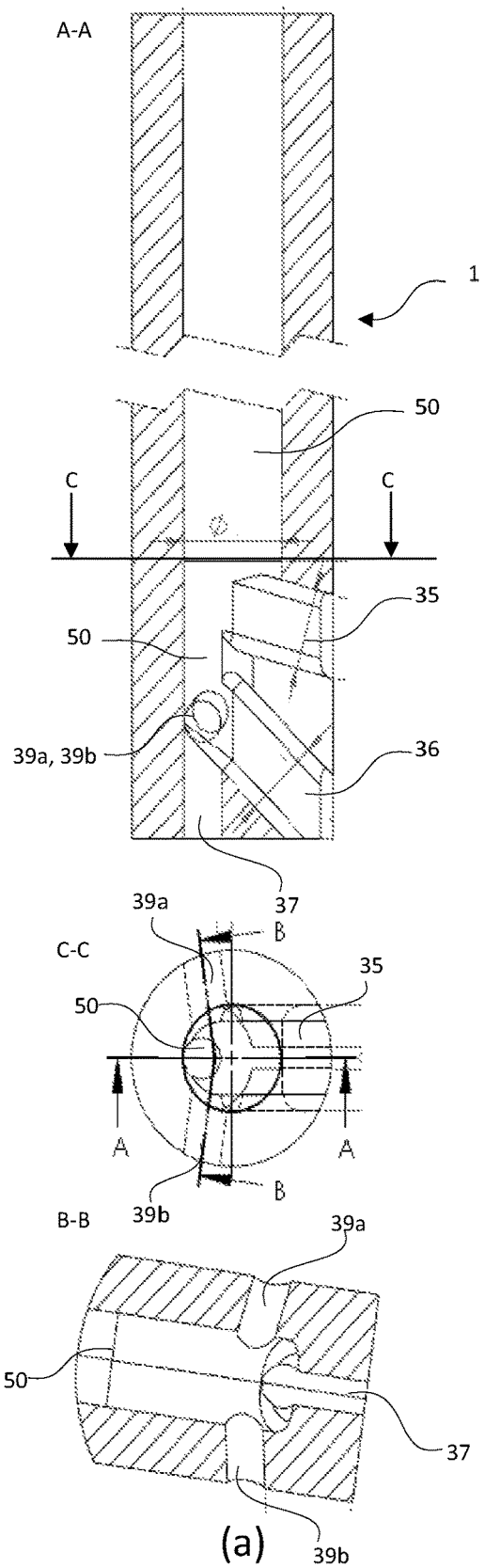
FIG. 3: shows embodiments of nozzles according to the present invention.
Figure 3:
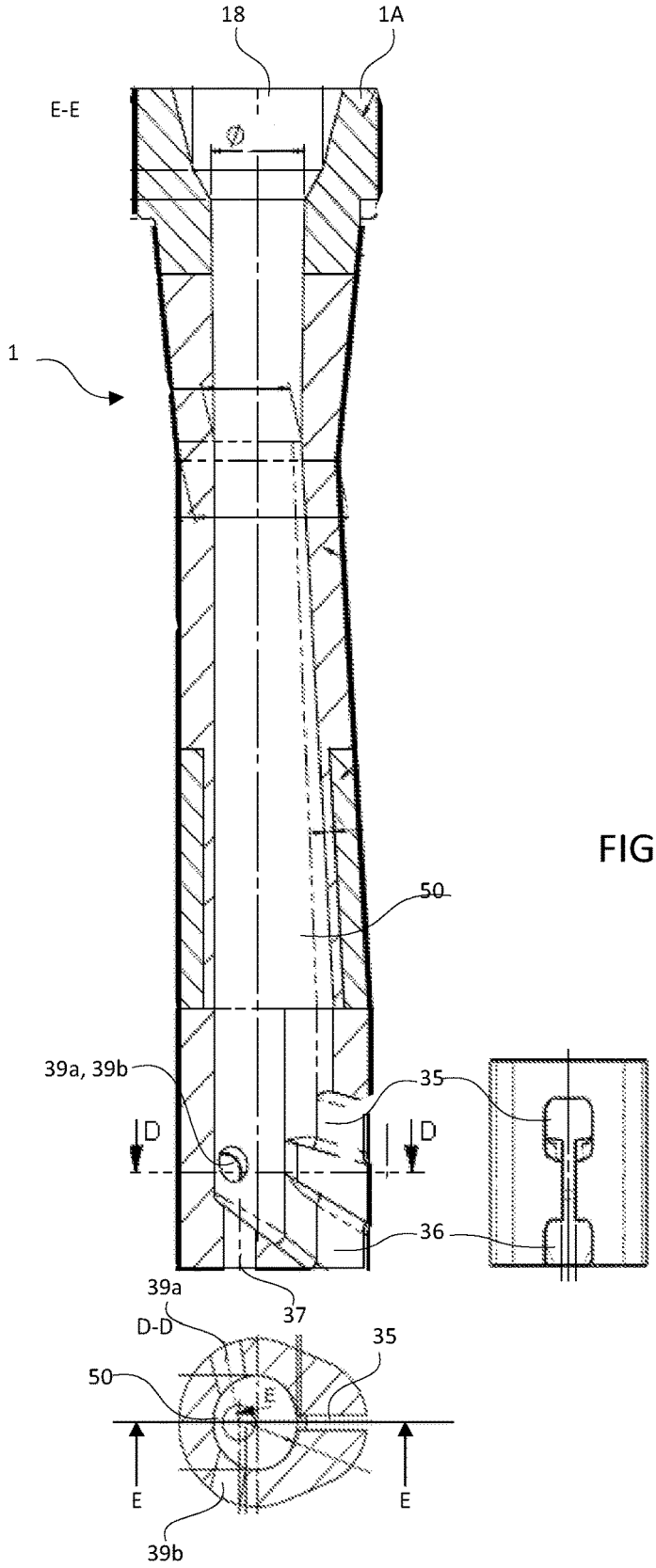
Figure 4:
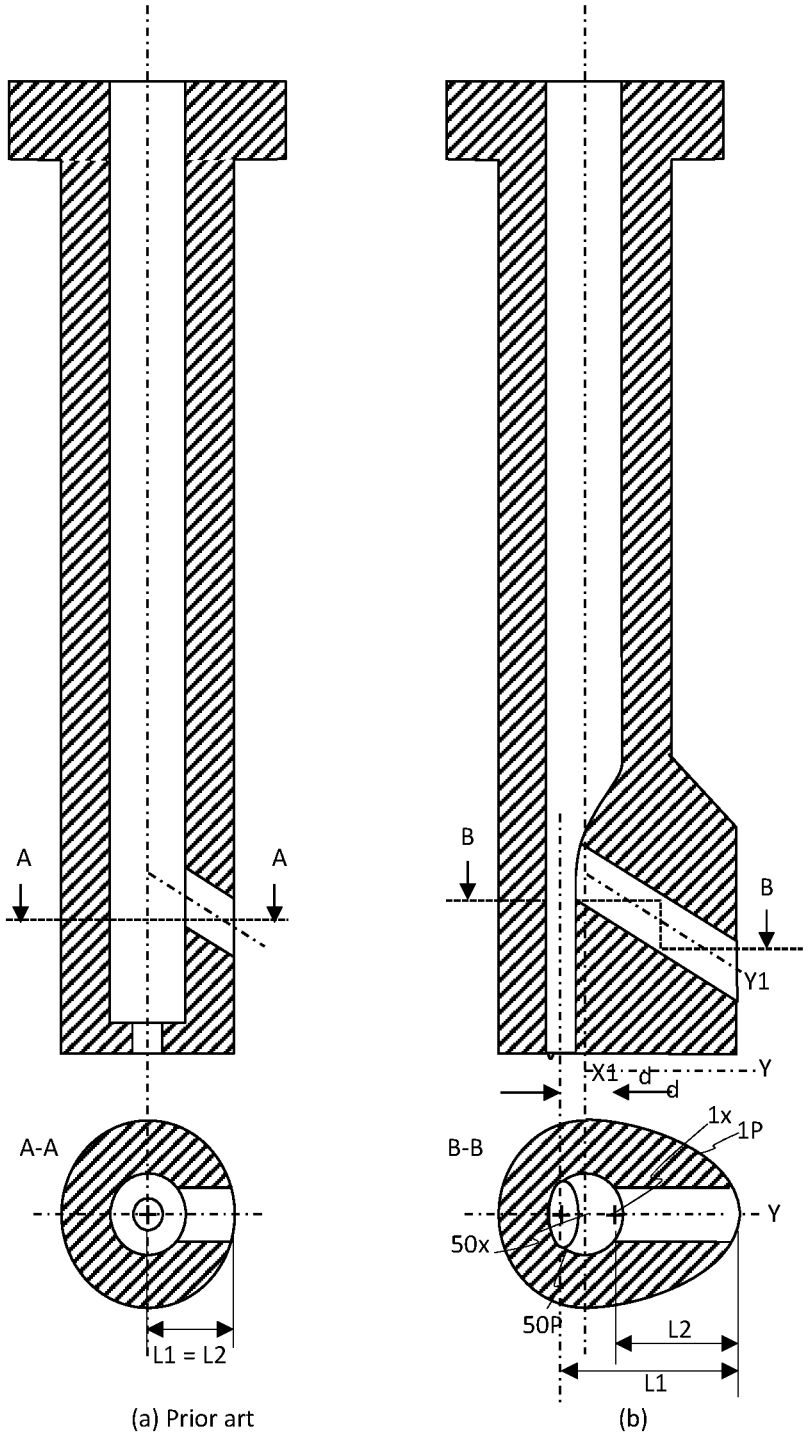
FIG. 4: shows a prior art nozzle (FIG. 4(*a*)) compared with further embodiments of nozzles according to the present invention.
Figure 4:
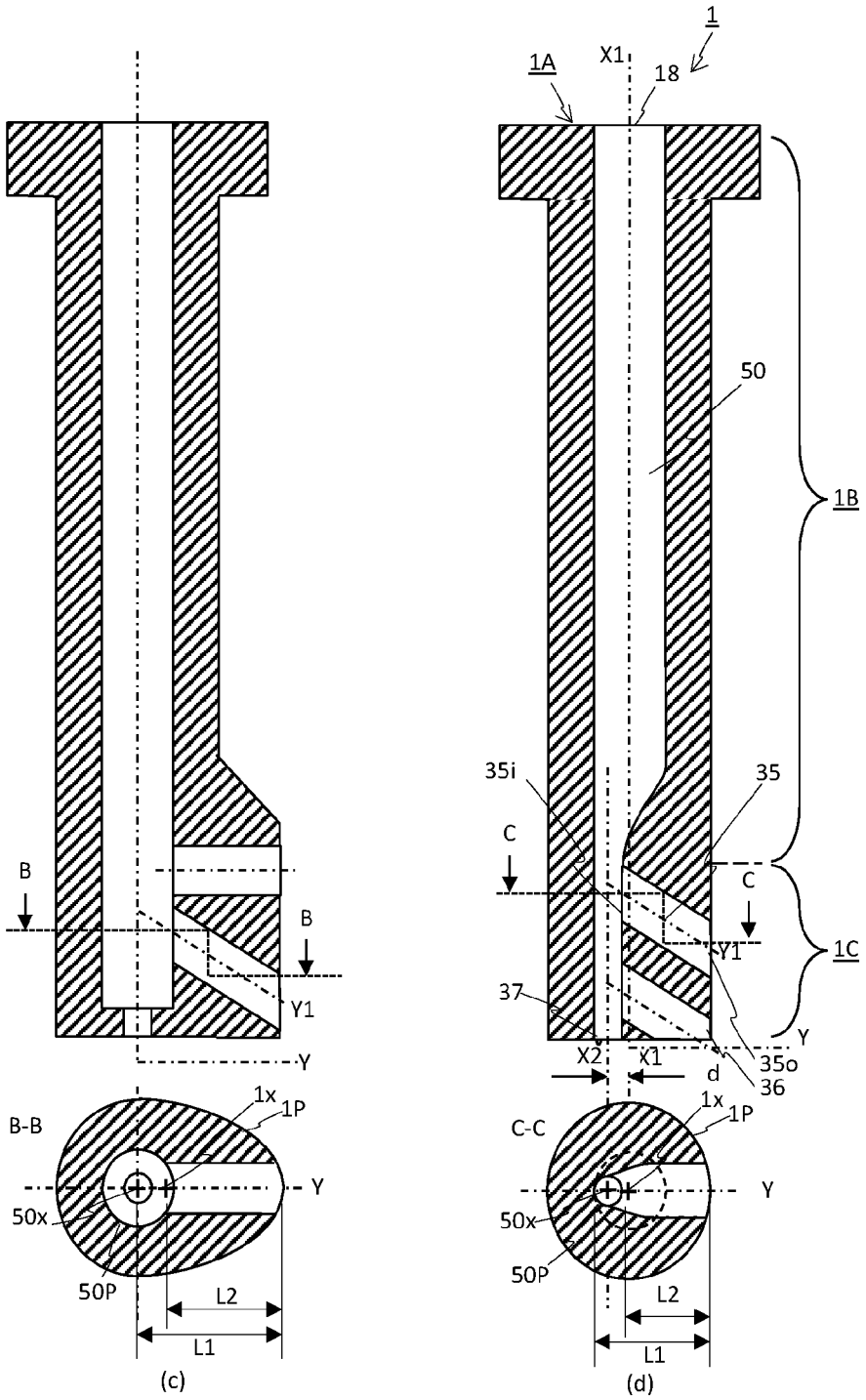

As illustrated in FIGS. 3&4, a nozzle according to the present invention can be divided into three main portions:

an inlet portion (1A), located at a first end of the nozzle and comprising an inlet orifice (18);

an elongated portion (1B) defined by an outer peripheral wall and extending along a first longitudinal axis, X1, from said inlet portion (1A), or adjacent thereto, to, an outlet portion (1C), located adjacent to and including a second end of the nozzle, opposite the first end, said outlet portion being defined by an outer peripheral wall and comprising a first outlet front port (35) opening on said outer peripheral wall.

The nozzle further comprises a bore (50) extending parallel to the first longitudinal axis, X1, opening at said inlet orifice (18) and extending along the elongated portion (1B) of the nozzle and at least partly in the outlet portion (1C) of the nozzle whence it opens to the atmosphere at least through said first front port (35), which extends along front port direction, Y1, transverse to said first longitudinal axis, X1, from a front port inlet (35*i*) joining the bore (50) to a front port outlet (35*o*) opening at the outer peripheral wall of the outlet portion of the nozzle.

Because a nozzle according to the present invention is particularly suitable for casting complex shapes, like H-beams, using a single nozzle per mould, which is located offset with respect to the plane of symmetry of the mould normal to the web, typically at the intersection of a flange (100*f*) and the web (100*w*) of the mould (100), the metal should not flow out of the nozzle front ports symmetrically with respect to a vertical plane passing by the longitudinal axis, X1. In particular, the first front port (35) is designed to extend, when in use, in a direction substantially parallel to the mould web (100*w*), and oriented away from the flange (100*f*) at which intersection with the web said nozzle is located. Because of the proximity of the outer wall (100*f*-out) of the mould flange located "behind" the nozzle front port (35) (cf. FIG. 6(*d*)), a nozzle according to the present invention comprises no front port extending along a direction opposite to the direction of the first front port (35) with respect to the longitudinal axis and belonging to the plane defined by the longitudinal axis, X1, and the front port axis, Y1.

In a planar cut of the nozzle outlet portion (1C) along a plane normal to the first direction, X1, passing through the front port inlet (35*i*), the following features can be identified:

the outline of the bore (50), defined by the bore perimeter (50P) and by the bore centroid (50*x*) of the area defined by said bore perimeter and, the outline of the outer peripheral wall of the outlet portion of the nozzle defined by the wall perimeter (1P) and the wall centroid (1*x*) of the area defined by said wall perimeter, and The segment extending along the first transverse axis, Y, from the bore centroid (50*x*), to the wall perimeter (1P) is longer than the segment extending from the wall centroid (1X) to the intersecting point between the first transverse axis, Y, and the wall perimeter (1P), It is essential that the bore centroid (50*x*) and wall centroid (1*x*) are distinct and separated by a distance, $d \neq 0$. The direction along which the first front port (35) extends linearly on said planar cut is defined by the first transverse axis, Y, which starts from the bore centroid (50*x*) and extends until the wall perimeter (1P). In a preferred embodiment, both bore centroid (50*x*) and wall centroid (1*x*) belong to the first transverse axis.

If the first front port (35) is inclined (i.e., if the front port direction, Y1, is not normal to the longitudinal axis, X1), it is possible that the front port outlet (35*o*) be out of the cut plane. This is the case, e.g., in FIG. 4(*b*)-(*d*), wherein the cuts B-B are made on two parallel planes for sake of clarity, such as to show the whole length of the first front port (35) from inlet (35*i*) to outlet (35*o*).

As discussed above, the "centroid" (50*x*, 1*x*) of an area is herein used in its traditional geometrical definition of the arithmetic mean ("average") position of all the points in the area, which is equivalent to the barycenter of the area having homogeneous density (i.e., ignoring that the refractory density is higher than the bore density). For simple figures such as circles, ellipses, the position of the centroid is easy to determine. For less regular geometries, however, it is not always straightforward to calculate the position of the centroid. FIG. 7 illustrates how to experimentally determine the position of the centroid of any two dimensional shape. The outline of the bore or peripheral wall is cut out from cardboard. The bore position should not be cut out of the cardboard representing the shape of the peripheral wall to ensure uniform density of the lamina. In FIG. 7, the outline of the peripheral wall of the nozzle discussed in FIG. 6(*d*) is represented, with the position of the circular bore indicated with a dashed line. (not cut out, though). The cardboard lamina is then held by a pin inserted at a first point near the lamina perimeter, in such a way that it can freely rotate around the pin; and a plumb line is dropped from the pin (cf. FIG. 7(*a*). The position of the plumbline is traced on the body (cf. dashed line in FIG. 7(*b*)). The experiment is repeated with the pin inserted at a different point of the lamina. The intersection of the two lines is the wall centroid (1*x*) (cf. black circle in FIG. 7(*b*)). This empirical method allows the determination of the centroid of any surface in a simple and reliable way.

The offset between wall and bore centroids needs not extend over the whole length of the nozzle. It suffices that such offset be present at the outlet portion, at the level of the first front port (35). Consequently, the bore (50) and the outer peripheral wall defining the elongated portion (1B) may be concentric about the first longitudinal axis, X1, over substantially the whole length of the elongated portion (1B), and the offset may be produced only at a lower portion of the nozzle, as illustrated in FIGS. 3(*a*) and 4(*b*)-(*d*). Alternatively, the offset between bore (50) and peripheral wall of the nozzle may extend along a substantial portion of the nozzle length, or even along the whole nozzle length as shown in FIG. 3(*b*).

Figure 6:
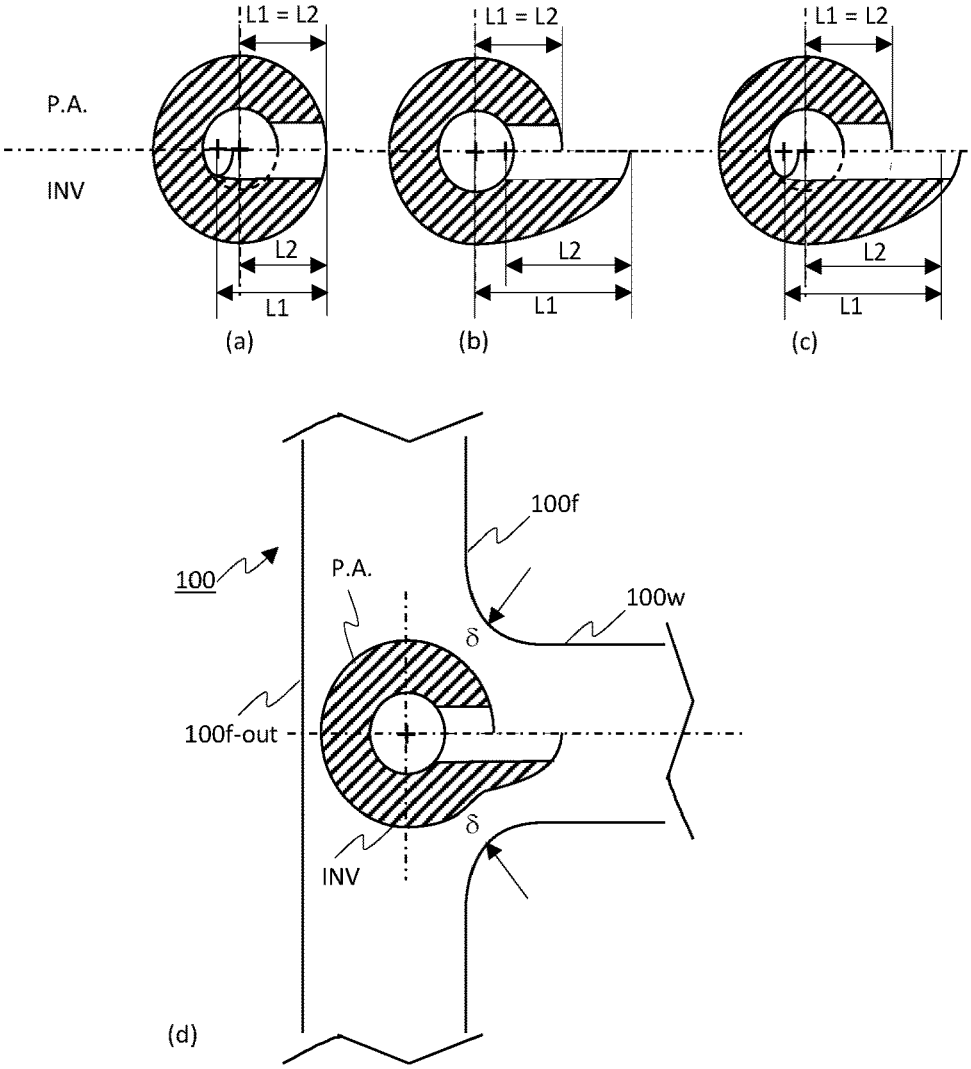
FIG. 6: compares the front port length of a nozzle of the prior art with nozzles according to the present invention.
Figure 7:
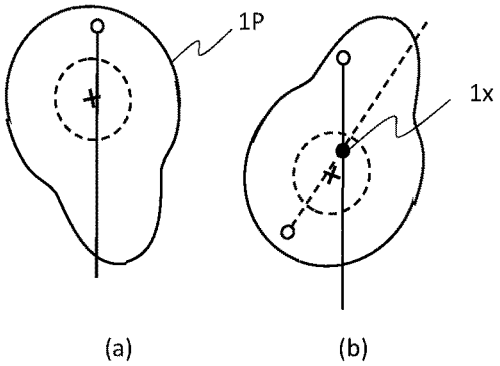
FIG. 7: illustrates how to determine experimentally the position of the wall centroid.

As illustrated in FIGS. 6(*a*)-(*d*), offsetting the bore with respect to the nozzle peripheral wall at the level of the first front port as proposed in the present invention permits a substantial increase of the length, L1>L2, of the first front port in a nozzle according to the present invention (cf. lower halves of FIGS. 6(*a*)-(*d*)) compared with the length, L1=L2, of a traditionally "co-axial" nozzle (cf. upper halves of FIGS. 6(*a*)-(*d*)). A longer first front port (35) has multiple advantages. First, it creates a substantially more stable metal melt flow out of the first front nozzle, jetting out at a relatively long distance along the mould web section and creating substantially less turbulences than shorter front ports. Second, as illustrated in FIG. 6(*d*), the front port outlet (35*o*) of a nozzle according to the present invention (lower half) extends deeper into the mould web section than a traditional "co-axial" nozzle (upper half), thus reducing the distance the metal jet must cover to fill the mould properly. Third, a longer front port (35) allows the reduction of momentum of the metal flow, thus reducing the impact force of the jet against the outer flange wall (100*f*-out) of the mould flange opposite the nozzle. This is important, since the impacting flow creates turbulences and rapidly erodes the flange outer wall of the mould. Finite element modelling (FEM) or computational fluid dynamics (CFD) show that high sub-meniscus velocities in the mould increase the risk of mould level fluctuations and of flow detachment at the level of the radii between web and flange opposite to the nozzle. The lowest sub-meniscus velocities were obtained with nozzles according to the present invention, due to enhanced momentum dissipation along the longer first front port (35).

Figure 5:
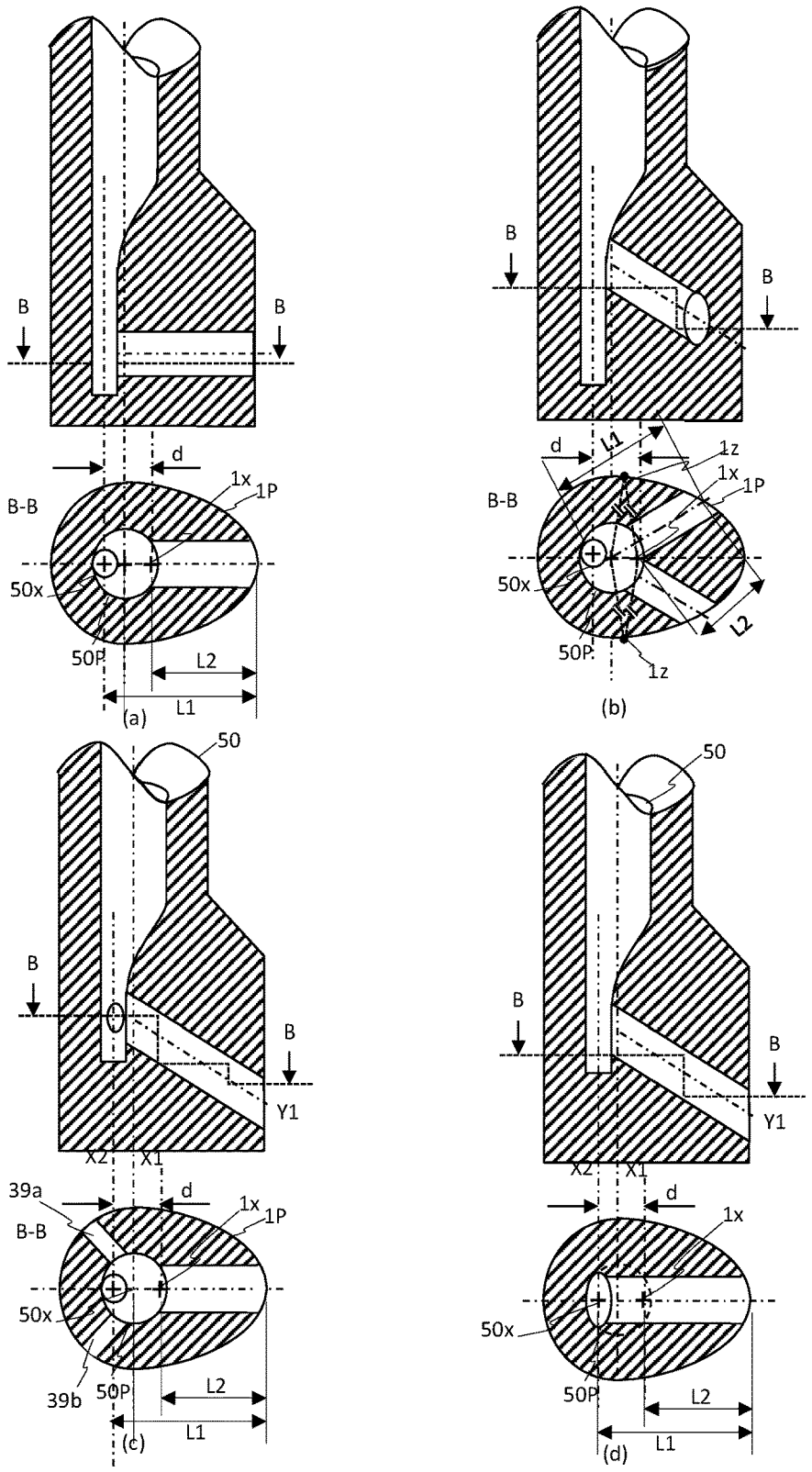
FIG. 5: shows further embodiments of the outlet portion of nozzles according to the present invention.
Figure 5:
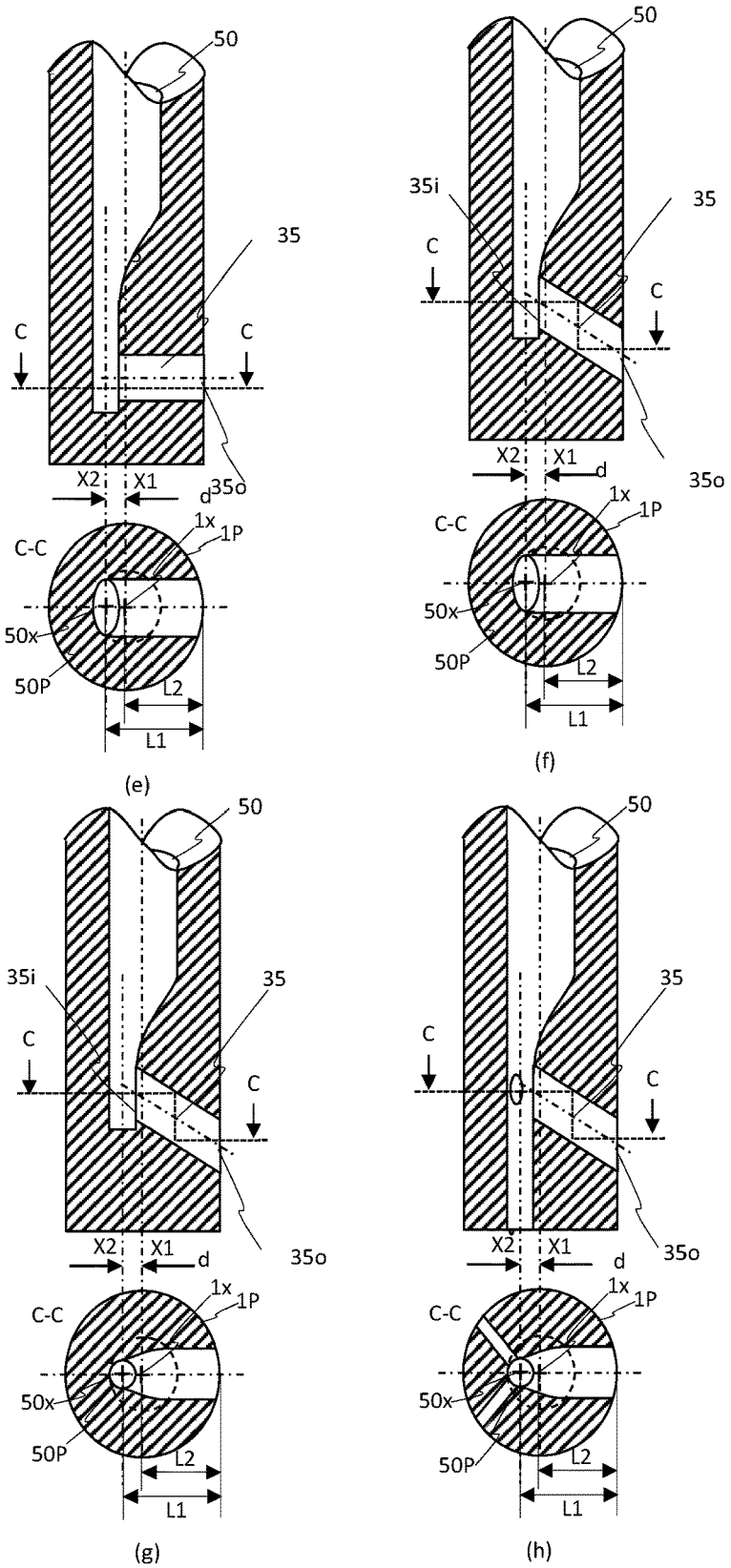

In one embodiment, illustrated in FIGS. 3(*a*), 4(*d*) and 5(*e*)-(*h*), the peripheral wall of both elongated portion (1B) and outlet portion (1C) can be centred about the longitudinal axis, X1, over substantially the whole length thereof and, at least at the level of the first front port (35), the bore (50) changes geometry extending along a second longitudinal axis, X2, parallel to, and offset with respect to the first longitudinal axis, X1, in the direction opposite to the first front port. The bore portion extending along the second longitudinal axis, X2, preferably gets thinner than the bore portion extending along the first longitudinal axis, X1. at least along the direction of the first transverse axis, Y. The thinner bore portion may be a homothety of the broader upstream bore portion, as illustrated in FIGS. 4(*d*) and 5(*g*)&(*h*), wherein the bore (50) maintains a circular cross-section along the whole length thereof, with a smaller diameter in the outlet portion (1C). Alternatively, the thinner bore portion may have a different cross-sectional shape as the broader upstream bore portion. FIG. 5(*e*)&(*f*) illustrates a broad upstream bore portion of circular cross section (cf. dashed line in said Figures) and a thinner, downstream bore portion having an elliptical cross-section, the minor diameter of the ellipse being along the first transverse direction, Y. Reducing the diameter of the downstream portion of the bore along the direction of the axis, Y, only has the advantage of allowing a greater offset, d, between the first and second longitudinal axes, X1 and X2, while maintaining a large enough bore cross-sectional area required for ensuring a desired metal flow rate. Whether the cross-sectional reduction of the downstream bore should be homothetic or along one direction only depends on the applications and a person skilled in the art is capable of dimensioning the bore portions accordingly.

In a second, alternative embodiment, illustrated in FIGS. 3(*b*), 4(*b*)&(*c*), and 5(*a*)-(*d*), the offset between bore and peripheral wall at the level of the front port is produced by centring the bore (50) about the first longitudinal axis, X1, over substantially the whole length of the bore, and broadening, at least at the level of the first front port, the outer peripheral wall (1P) in the direction of the first transverse axis, Y, compared with the opposite direction. If, as illustrated in FIGS. 4(*b*), (*c*) and 5(*a*)-(*d*), the broadening of the outer peripheral wall of the nozzle is restricted to the lower portion of the nozzle, it permits to save substantial amounts of refractory material. Else, there is no particular restriction to the level of the nozzle the outer peripheral wall should start broadening.

In a third embodiment, the former two embodiments are combined as illustrated in FIGS. 5(*d*) and 6(*c*), wherein, at least at the level of the first front port (35), the outer peripheral wall (1P) of the nozzle broadens along the direction of the first transverse axis, Y, and the bore cross-section is reduced at least in the direction of said first transverse axis, Y, such that the bore extends along said second longitudinal axis, X2. This embodiment allows the greatest elongation of the first front port (35) as illustrated in FIG. 6, wherein the first embodiment discussed supra is illustrated in FIG. 6(*a*), the second embodiment, in FIG. 6(*b*), and the third embodiment, in FIG. 6(*c*), with the length, L1, of the first front port (35) increasing sequentially with the embodiments (a), (b), (c).

The front port direction, Y1, along which extends the first front port (35) may be normal to the first longitudinal axis, X1. This would correspond to a horizontal front port (35) as illustrated in FIGS. 4(*c*) and 5(*a*)&(e), wherein the term "horizontal" is used with respect to the position of the nozzle in use). Alternatively, the front port direction, Y1, may be transverse but not normal to the first longitudinal axis, X1. In particular, the first front port (35) may extend downwards (with respect to the position of the nozzle in use) such that the centroid of the front port outlet (35*o*) is closer to the nozzle second end than the centroid of the front port inlet (35*i*).

For a proper filling of complex shaped moulds, a single front port may not be sufficient. A nozzle according to the present invention may therefore further comprise an end outlet (37) opening at the second end of the nozzle (cf. FIGS. 4 and 5(*c*)&(*h*)). The end outlet (37) is preferably parallel to the longitudinal axis, but it may form an angle with the latter. An end outlet (37) is formed by a channel in fluid communication with the longitudinal bore and opening exclusively at the second end of the nozzle. If a channel opening extends partly at the second end and partly at the peripheral wall of the nozzle, it is referred to as a front port (cf. e.g., FIG. 3). It may also comprise at least one secondary front port (39*a*, 39*b*) extending transversally to the longitudinal axis, X1, and front port direction, Y1, from the bore (50) to the peripheral wall of the outlet portion (1C). For a H-mould as illustrated in FIGS. 1 and 2, the nozzle preferably comprises two secondary front ports (39*a*, 39*b*) forming with the first front port (35) a Y centred on the bore such that the flange adjacent the nozzle may be filled with metal melt as illustrated in FIGS. 3 and 5(*c*)&(*h*).

In most embodiments, the nozzle comprises a single front port (35) characterized by a first transverse axis, Y, which is coaxial with the longest of all segments extending from the centroid (50*x*) of the bore to the wall perimeter (1P) (cf. all but FIG. 5(*b*)). In some specific cases, however, it is possible to have two front ports (35) each characterized by a first transverse axis, Y, forming a "V" shape, as illustrated in FIG. 5(*b*). In this specific embodiment, in order to fulfil the requirement of L1>L2, each of the first transverse axes, Y, of the first and second front ports (35) cannot intersect the wall perimeter (1P) at nor beyond the boundary points (1Z), which defines the position in the peripheral wall wherein L1=L2. Right of the boundary points (1Z) in FIG. 5(*b*), L1>L2 in agreement with the present invention, but left thereof, L1<L2, and they become secondary front ports (39, 39*a*, 39*b*) as discussed above.

Further dissipation of the flow momentum and enhanced flow stability may be obtained by providing the nozzle with a second front port (36) extending along an axis comprised within the half-plane defined by the first longitudinal axis, X1, and the first transverse axis, Y. In other words, as illustrated in FIG. 4(*c*)&(*d*), a second front port (36) can be located above or below the first front port (the terms "above" and "below" being used herein with respect to the nozzle position in use). In a variation of the present embodiment, the first and second front ports (35, 36) may be connected by a thinner channel as illustrated in FIG. 3, conferring a dog-bone shape to the front ports outlets.

Figure 1:
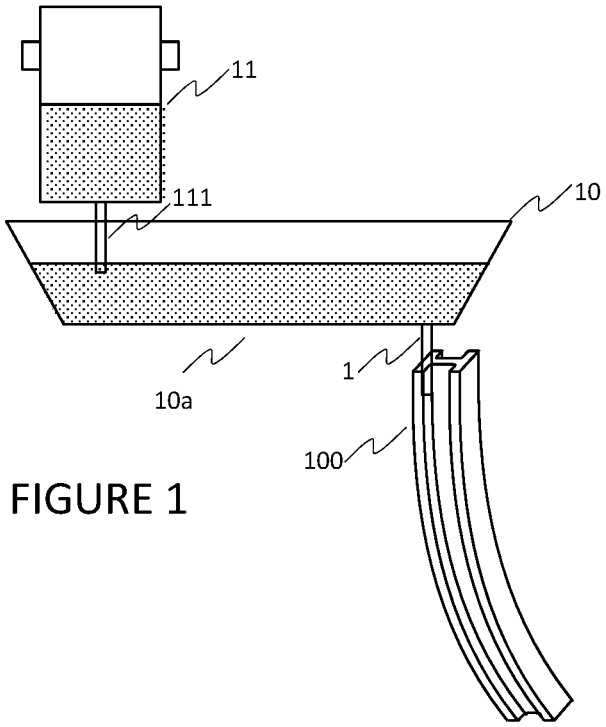
FIG. 1: represents a general view of a casting installation for casting a metal beam.
Figure 2:
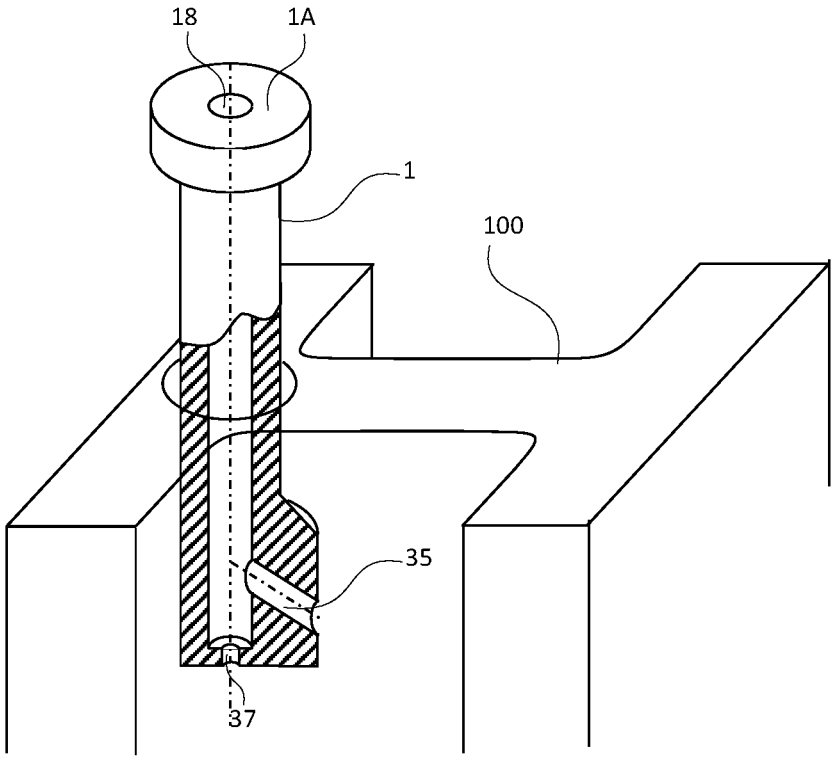
FIG. 2: shows an example of nozzle according to the present invention inserted in a H-mould.

A nozzle according to the present invention is advantageous in use with an installation for casting metal beams as illustrated in FIG. 1 and comprising:

(a) A metallurgical vessel (10, 11) provided with at least one submerged nozzle (1) according to the present invention with the inlet orifice (18) thereof being in fluid communication with the interior of the metallurgical vessel; and wherein the bore (50) with the first front port (35) extends out of said metallurgical vessel and penetrating partially in, (b) A beam blank mould (100) defining a cross-section divided in at least a first elongated portion extending along a first mould direction and at least a second elongated portion, extending along a second mould direction transverse to the first mould direction.

wherein, said first mould direction is comprised within the plane defined by the first longitudinal axis, X1, and the front port axis, Y1, and is preferably normal to the first longitudinal axis, X1.

The blank beam mould can have a T-, an L-, an X-, a C-, a H- or similar cross-section. In case of a H- or a C-cross-section, the web of the H or C being defined by the first elongated portion, and the two lateral flanges of the H or C being defined by the second elongated portion and a third elongated portion, both normal to the first elongated portion. One single such submerged nozzle is preferably used for each mould and is positioned at the area intersecting the web and a flange of the H- or C-beam cross-section. Similarly, in case of T-, L-, or X-cross-sections, a single nozzle is preferably used for each mould, and is preferably positioned at the intersecting area between the first and second elongated portions of the mould. For such moulds, additional front ports extending transverse to said front port (35), with an offset between the centroids of the bore and peripheral wall at the level of such front ports positions can be envisaged in case of two intersecting elongated portions of a mould having extensive lengths.

In order to allow a sufficient clearance, δ, between the nozzle peripheral wall and the mould wall, in particular close to the front port, the outer peripheral wall of the nozzle may have a cross-sectional shape roughly matching the contours of the mould walls in the vicinity of the nozzle. For example the cross-sectional shape of the peripheral wall may have a pear or bulb like shape as illustrated in FIG. 6(*d*). As discussed supra, a sufficient clearance, δ, is required to prevent formation of solidified metal bridges between the nozzle and the cold mould walls. Such shape of the outer peripheral wall of the nozzle allows a deeper penetration of the first front port (35) in the direction of the mould web (i.e. first elongated portion) while maintaining a sufficient clearance with the mould walls (compare upper (PA) and lower (INV) halves of FIG. 6(*d*)).

A nozzle according to the present invention permits a better control of the metal jet flowing out thereof into complex shaped moulds for producing beams and the like. With the greater length, L1, of the first front port (35) than hitherto possible. This has the advantages of enhanced flow momentum dissipation as well as higher stability and lower velocity of the outpouring metal jet. This in turn prevents flow disruption at the radii of complex shaped moulds, as well as decreasing the formation of vortices and dead zone, responsible for many defects in cast beams.

Numerous modifications and variations of the present invention are possible. It is, therefore, to be understood that within the scope of the following claims, the invention may be practiced otherwise than as specifically described.

The invention claimed is:

1. Submerged nozzle for casting steel having an exterior and comprising:

an inlet portion, located at a first end of the nozzle and comprising an inlet orifice;

an elongated portion defined by an outer peripheral wall and extending along a first longitudinal axis from said inlet portion, or adjacent thereto, to, an outlet portion, located adjacent to and including a second end of the nozzle, opposite the first end, said outlet portion being defined by an outlet portion outer peripheral wall and comprising a first outlet front port opening on said outlet portion outer peripheral wall, a bore extending parallel to the first longitudinal axis opening at said inlet orifice and extending along the elongated portion of the nozzle and at least partly in the outlet portion of the nozzle whence it opens to the exterior at least through said first front port, which extends along a front port direction transverse to said first longitudinal axis from a front port inlet joining the bore to the first outlet front port opening at the outer peripheral wall of the outlet portion of the nozzle, wherein a planar cut of the nozzle outlet portion along a plane normal to the first longitudinal axis passing through the front port inlet comprises:

an outline of the bore, defined by a bore perimeter and by a bore centroid of an area defined by said bore perimeter and, an outline of the outer peripheral wall of the outlet portion of the nozzle defined by a wall perimeter and a wall centroid of an area defined by said wall perimeter, and a first transverse axis passing by the bore centroid and extending along a direction parallel to an orthogonal projection of the front port direction onto a plane of the cut, wherein, the peripheral wall of both the elongated portion and the outlet portion is centred about the first longitudinal axis over substantially a whole length of the nozzle, and wherein at least at the level of the first front port, the bore changes geometry extending along a second longitudinal axis parallel to, and offset with respect to the first longitudinal axis in the direction opposite to the first front port, the nozzle comprises no front port extending along a direction opposite to the direction of the first front port with respect to the first longitudinal axis and belonging to a plane defined by the first longitudinal axis and the front port direction and wherein, in said planar cut:

the bore centroid and wall centroid are distinct and separated by a distance $d \neq 0$, A segment extending along the first transverse axis from the bore centroid, to the wall perimeter has a length L1 which is longer than a length L2 of a segment extending from the wall centroid to an intersecting point between the first transverse axis and the wall perimeter.

2. Submerged nozzle according to claim 1, wherein, the bore and the outer peripheral wall defining the elongated portion are concentric about the first longitudinal axis over substantially the whole length of the elongated portion.

3. Submerged nozzle according to claim 1, wherein the bore is centred about the first longitudinal axis over substantially the whole length thereof, and wherein at least at the level of the first front port, the outer peripheral wall defining the outlet portion broadens in the direction of the first transverse axis compared with an opposite direction.

4. Submerged nozzle according to claim 1, wherein the change in geometry of the bore comprises a thinning cross-section at least along the direction of the first transverse axis.

5. Submerged nozzle according to claim 1, wherein the outlet portion further comprises an end outlet opening at the second end of the nozzle.

6. Submerged nozzle according to claim 1, wherein the outlet portion further comprises at least one secondary front port extending transversally to a plane defined by the first longitudinal axis and the front port direction.

7. Submerged nozzle according to claim 1, wherein the front port extends along a front port direction forming an angle less than 90° with the second longitudinal axis such that a centroid of the front port outlet is closer to the nozzle second end than a centroid of the front port inlet.

8. Submerged nozzle according to claim 7, wherein the first and second longitudinal axes and are coaxial.

9. Submerged nozzle according to claim 1, wherein the outlet portion further comprises a second front port extending on the same side as the first front port with respect to the first longitudinal axis and along an axis comprised within a half-plane defined by the first longitudinal axis and the first transverse axis.

10. Submerged nozzle according to claim 1, wherein the bore centroid is on the first transverse axis.

11. Submerged nozzle according to claim 1, wherein the ratio L1/L2 is at least equal to 1.05.

12. Casting installation for casting metal beams comprising:

(a) A metallurgical vessel provided with at least one submerged nozzle extending parallel to a first longitudinal axis and coupled to a floor of the metallurgical vessel, said at least one submerged nozzle comprising an inlet portion, located at a first end of the at least one submerged nozzle and comprising an inlet orifice;

an elongated portion defined by an outer peripheral wall and extending along a first longitudinal axis from said inlet portion, or adjacent thereto, to, an outlet portion, located adjacent to and including a second end of the at least one submerged nozzle, opposite the first end, said outlet portion being defined by an outlet portion outer peripheral wall and comprising a first outlet front port opening on said outlet portion outer peripheral wall, a bore extending parallel to the first longitudinal axis opening at said inlet orifice and extending along the elongated portion of the at least one submerged nozzle and at least partly in the outlet portion of the at least one submerged nozzle whence it opens to the atmosphere at least through said first outlet front port, which extends along a front port direction transverse to said first longitudinal axis from a front port inlet joining the bore to a front port outlet opening at the outer peripheral wall of the outlet portion of the at least one submerged nozzle, wherein a planar cut of the nozzle outlet portion along a plane normal to the first longitudinal axis passing through the front port inlet comprises:

an outline of the bore, defined by a bore perimeter and by a bore centroid of an area defined by said bore perimeter and, an outline of the outer peripheral wall of the outlet portion of the at least one submerged nozzle defined by a wall perimeter and a wall centroid of an area defined by said wall perimeter, and a first transverse axis passing by the bore centroid and extending along a direction parallel to an orthogonal projection of the front port direction onto a plane of the cut, (b) A beam blank mould defining a cross-section divided in at least a first elongated portion extending along a first mould direction and at least a second elongated portion, extending along a second mould direction transverse to the first mould direction, wherein, the at least one submerged nozzle comprises no front port extending along a direction opposite to a direction of the first front port with respect to the first longitudinal axis and belonging to a plane defined by the first longitudinal axis and the front port direction and wherein, in said planar cut:

the bore centroid and wall centroid are distinct and separated by a distance $d \neq 0$, A segment extending along the first transverse axis from the bore centroid, to the wall perimeter has a length, L1, which is longer than a length, L2, of a segment extending from the wall centroid to an intersecting point between the first transverse axis and the wall perimeter, and wherein, said first mould direction is comprised within a plane comprising the first longitudinal axis and the front port direction.

13. Casting installation according to claim 12, wherein the blank beam mould has a cross-section configuration selected from a group consisting of: T-cross-section, an L-cross-section, an X-cross-section, a C-cross-section, and a H-cross-section.

14. Casting installation according to claim 12, wherein the blank beam mould has a H-cross-section with a web of the H being defined by a first elongated portion, and two lateral flanges being defined by a second elongated portion and a third elongated portion, both normal to the first elongated portion, and wherein said at least one submerged nozzle is positioned at an area intersecting the web and a flange of the H-beam cross-section.

15. Casting installation according to claim 12, wherein a single submerged nozzle is used with each blank beam mould and said single submerged nozzle is positioned at an area intersecting a first and a second elongated portion of each blank beam mould.

* * * * *